United States Patent [19]

Saito et al.

[11] Patent Number: 4,869,843

[45] Date of Patent: Sep. 26, 1989

[54] HIGH-DENSITY GRANULAR DETERGENT COMPOSITION

[75] Inventors: Kozo Saito, Pittsburgh, Pa.; Fumio Sai; Moriyasu Murata, both of Utsunomiya, Japan

[73] Assignee: Kao Corporation, Tokyo, Japan

[21] Appl. No.: 212,124

[22] Filed: Jun. 24, 1988

Related U.S. Application Data

[62] Division of Ser. No. 2,546, Jan. 13, 1987, abandoned.

[30] Foreign Application Priority Data

Jan. 17, 1986 [JP] Japan ..... 61-7598
Jan. 17, 1986 [JP] Japan ..... 61-7599
Apr. 9, 1986 [JP] Japan ..... 61-81892

[51] Int. Cl.[4] ..... C11D 3/06

[52] U.S. Cl. ..... 252/135; 252/91; 252/140; 252/174.13; 252/174.14; 252/174.25; 252/186.25; 252/530; 252/531; 252/534; 252/540

[58] Field of Search ..... 252/135, 140, 530, 531, 252/534, 540, 174.13, 186.25, 174.14, 91, 174.25

[56] References Cited

U.S. PATENT DOCUMENTS

| | | | |
|---|---|---|---|
| 3,703,470 | 11/1972 | Brennan | 252/99 |
| 3,769,222 | 10/1973 | Yurko et al. | 252/89 |
| 4,075,117 | 2/1978 | Morton et al. | 252/534 |
| 4,137,197 | 1/1979 | Kowalchuk | 252/135 |
| 4,299,716 | 11/1981 | Cottrell et al. | 252/174.14 |
| 4,328,114 | 5/1982 | Johnson et al. | 252/135 |
| 4,344,871 | 8/1982 | Allaway et al. | 252/174.25 |
| 4,486,327 | 12/1984 | Murphy et al. | 252/95 |
| 4,652,391 | 3/1987 | Balk | 252/174.25 |
| 4,663,194 | 5/1987 | Wixon | 252/140 |
| 4,666,738 | 5/1987 | Wixon | 252/140 |
| 4,783,281 | 11/1988 | Bishop et al. | 252/174.14 |

FOREIGN PATENT DOCUMENTS

| | | |
|---|---|---|
| 1070210 | 1/1980 | Canada . |
| 80222 | 6/1983 | European Pat. Off. . |
| 48-61511 | 8/1973 | Japan . |
| 53-36508 | 4/1978 | Japan . |
| 58-132093 | 8/1983 | Japan . |
| 59-190216 | 10/1984 | Japan . |
| 195667 | 11/1985 | Japan . |
| 1580047 | 11/1980 | United Kingdom . |

*Primary Examiner*—Paul R. Michl
*Assistant Examiner*—Hoa Van Le
*Attorney, Agent, or Firm*—Flynn, Thiel, Boutell & Tanis

[57] ABSTRACT

A granular detergent composition having a high density comprises an organic surfactant, a water-soluble, crystalline, inorganic salt, another inorganic salt and/or an organic sequestering agent for a divalent metal and a granular, water-soluble, crystalline, alkaline, inorganic salt, said alkaline salt having been blended in the dry state with a base comprising the above other three components. Instead of the alkaline salt, a granular, water-soluble, crystalline, inorganic salt having carried thereon an organic substance being capable of inhibiting hydration may be used.

10 Claims, No Drawings

HIGH-DENSITY GRANULAR DETERGENT COMPOSITION

This application is a division of U.S. Ser. No. 2,546, filed Jan. 13, 1987, now abandoned.

The present invention relates to a high-density granular detergent. More particularly, the invention relates to a high-density granular detergent composition having high dispersibility and solubility even in cold water.

STATEMENTS OF PRIOR ARTS

Recently, the demand for high-density powdery detergents is increasing so as to save resources or from the viewpoint of the transportation thereof, easiness in carrying by the users or storage space.

As for the high-density powdery detergents, a granulated detergent composition containing at least 30% of a surfactant and having a bulk density of at least 0.5 g/cm$^3$ and granule diameter in the range of 0.5 to 5 mm is disclosed in the specification of Japanese Patent Laid-Open No. 61511/1973. Further, a detergent containing 30 to 70% of a surfactant and a specified amount of a detergent builder and having a bulk density of at least 0.55 g/cm$^3$ prepared by dry-blending method is disclosed in the specification of Japanese Patent Laid-Open No. 36508/1978.

In addition, a granular detergent composition comprising an intimately mixed anionic surfactant and anionic polymer is disclosed in the specification of Japanese Patent Laid-Open No. 132093/1983. According to this invention, the intimate mixture of a nonsoap anionic surfactant and a specified water-soluble anionic polymer is prepared previously so that the dispersibility and solubility of the granular detergent are improved by inhibiting or retarding the formation of a highly viscous gum phase comprising water and the anionic surfactant which delays the dissolution of the granules even in a granular detergent having a high density (for example, 0.67 g/cm$^3$) obtained by adding a detergent component to a spray-dried granular mixture prepared by using a water-soluble neutral or alkaline salt or a mixture of them.

However, such a high-density powdery detergent has usually unsatisfactory dispersibility or solubility. Though the detergent composition disclosed in the specification of said Japanese Patent Laid-Open No. 132093/1983 exhibits some effects, its dispersibility and solubility are yet insufficient under ordinary conditions in winter in Japan, since a mass of the detergent granules is left to stand in cold water used generally for washing in winter without application of a relatively high mechanical power in the initial stage for a certain period of time. Thus, said problem has not fully been solved as yet.

For example, cold water at 5° C. is usually used domestically for washing in winter in Japan. When such a cold water is used in a domestic, fully-automatic washing machine, the washing and detergent are first placed therein and then the machine is switched on to pour water and to start the washing. During the pouring of water, water penetrates gradually into the mass of the detergent granules while substantially no physical o mechanical power is applied thereto and a pasty phase comprising a mixture of the detergent components of a quite high concentration and water is formed on the granule surface to cause coalescence of the granules. Further, the mass of the granules is covered with a hydrated, highly viscous pasty phase so that the particles cannot be dispersed again thoroughly by the mechanical stirring force applied to them thereafter. Thus, the granules cannot be dissolved thoroughly within an ordinary washing time. Such a phenomenon is undesirable for the users. The highly viscous pasty phase is formed easily particularly when the surfactant contained in the composition is mainly an anionic surfactant.

On the contrary, in an ordinary low-density detergent such as that obtained by a mere spray-drying, the detergent granules are porous and contain a large amount of air and, therefore, they rise easily to the water surface and disperse by their buoyancy. Even when the coalescence of the granules occur once in water, they are dispersed and dissolved again by the mechanical power, since the density of the formed mass per se is low and the mass contains a relatively large amount of air. Thus, said problem does not occur in the low-density detergents.

Under these circumstances, the inventors noticed the surfactants, particularly anionic surfactants in the composition of the high-density granular detergents as mentioned in the specification of said Japanese Patent Laid-Open No. 132093/1983. In the inventors' investigations, various viscosity depressants, hydrotrops, etc. were added to the composition so as to inhibit the formation of the highly viscous pasty phase. After the investigations, the inventors have found that said problems cannot be solved entirely under the above-mentioned washing conditions in winter in Japan, though only a slight improvement can be obtained. It is thus apparent from the investigations that though the formation of the viscous pasty phase comprising the anionic surfactant and water is one of the causes for the inhibition of the dispersion and dissolution of the high-density granular detergent, it is not the primary cause.

For the incorporation of a nonionic surfactant in a powdery detergent, a process wherein the nonionic surfactant is added to a slurry of the detergent and the obtained mixture is spray-dried, a process wherein said surfactant is adhered to the spray-dried particles of the detergent or said particles are impregnated with the surfactant, or a process wherein said surfactant is directly mixed with a powdery builder component such as an inorganic salt has been employed. When the nonionic surfactant used in the above-mentioned processes has a melting point of below about 30° C., this surfactant oozes out from the product thus obtained to damage the fluidity of the particles and to reduce the commercial value of the product seriously during the storage and before the users use the same. In the process wherein the mixture of the detergent slurry and the surfactant is spray-dried, a white fume and a bad smell are given out due to a thermal reaction and they are entrained in an exhaust gas from the drying apparatus to pollute the environment unfavorably.

Various means of solving these problems have been proposed such as the use of a nonionic surfactant having a high melting point, reduction in the amount of the nonionic surfactant and packing of the detergent in a polyethylene bag in a paper vessel so that the oozing nonionic surfactant will not stain the outside of the package.

To exhibit the maximum deterging capacity of the detergent, the kind and amount of the nonionic surfactant used were limited strictly due to the above-mentioned problems. To relax the limitations, the development of a process for preparing a powdery detergent containing any sort of nonionic surfactants and having a high fluidity but free of oozing of the nonionic surfactant during the storage has been demanded.

SUMMARY OF THE INVENTION

After further investigations made for the purpose of finding the primary cause, the inventors have found that, when the high-density granular detergent is placed in water at a quite low temperature, water penetrates into the mass of the detergent granules through the surface thereof and, accordingly, the surfactant is hydrated and water-soluble salts are also hydrated to generate heat of hydration and then dissolved in water. As water in which the salts are dissolved penetrates further into the mass, the concentration of the formed salt solution is increased and, finally, the temperature the surrounding low-temperature system. As a result, the solution becomes supersaturated to precipitate crystals, which further harden the viscous pasty phase of the surfactant. Moreover, the crystals thus formed are connected with one another to convert the phase per se into a firm, hydrated solid phase, which is difficultly dispersed or dissolved by a mechanical force applied thereafter. Namely, the inventors have found that the presence of the water-soluble, crystalline salts is the principal cause for the inhibition of the dispersion and dissolution of the high-density granular detergent in cold water.

On the other hand, the water-soluble, crystalline inorganic salts are indispensable components necessitated for improving the producibility and washing capacity of the detergent.

After intensive investigations made for the purpose of solving said problems, the inventors have found that a high-density granular detergent having high dispersibility, solubility and deterging capacity in cold water can be obtained by limiting the amount of the water-soluble, crystalline salts which inhibit the dispersion and dissolution and which are contained in the high-density granular detergent stock and dry-blending alkaline water-soluble, crystalline salts with the stock in a limited ratio, these salts being selected from said water-soluble, crystalline salts and in granular form, to localize the same. The present invention has been completed on the basis of this finding.

A granular detergent composition (I) of the invention, having a high density, comprises:

(a) 20 to 60 wt. % of an organic surfactant, (b) 2 to 15 wt. % of a water-soluble, crystalline, inorganic salt, (c) 25 to 78 wt. % of another inorganic salt and/or an organic sequestering agent for a divalent metal, and (d) 5 to 25 wt. % of a granular, watersoluble, crystalline, alkaline, inorganic salt, said (d) having been blended in the dry state with a base comprising the (a), the (b) and the (c).

A preferable composition (II) comprises 20 to 60 wt. % of the (a), up to 15 wt. % of the (b), 25 to 80 wt. % of the (c) and (e) 5 wt. % or more of a granular, water-soluble, crystalline, inorganic salt having carried thereon an organic substance being capable of inhibiting hydration, said (e) having been blended in the dry state with a base comprising the (a), the (b) and the (c).

Another preferable composition (III) comprises 20 to 60 wt. % of the (a), 2 to 15 wt. % of the (b), and 25 to 78 wt. % of the (c), said salt (b) containing 2 wt. % or more, based on said (b), of an alkaline, inorganic salt, the total amount of the alkaline, inorganic salt(s) being 20 wt. % or more in the composition.

It is more preferably particles of a water-soluble, crystalline, inorganic salt having carried thereon an organic substance having a melting point of 40° C. or lower and being capable of inhibiting hydration, said particles having been coated with an organic substance being capable of inhibiting hydration and having a melting point of 40° C. or higher. The above defined salt (e) is preferably particles of an inorganic substance having carried thereon a nonionic surfactant and having been coated with polyethylene glycol. The salt (e) has another preferable embodiment which has been prepared by mixing particles of an inorganic substance not substantially liberating water of crystallization at 50° C. or lower with a nonionic surfactant at a temperature of not lower than the melting point of said nonionic surfactant, mixing the mixture with an aqueous solution of polyethylene glycol while agitating and pulverizing the resultant compound.

The invention provides a high-density granular detergent composition (I). It is prepared by dry-blending 5 to 25 wt. % of granular, water-soluble, crystalline alkaline inorganic salt(s) with a high-density granular detergent stock comprising (a) 20 to 60 wt. % of organic surfactant(s), (b) 2 to 15 wt. % of water-soluble, crystalline inorganic salt(s) and (c) 25 to 78 wt. % of other inorganic salt(s) and/or organic sequestering agent(s) for divalent metals.

The term "high-density" herein means a bulk density of at least 0.5 g/cm$^3$, preferably at least 0.6 g/cm$^3$.

The organic surfactants contained in the high-density granular detergent stock of the present invention include the following ones:

anionic surfactants such as straight-chain or branched alkylbenzenesulfonates, alkyl or alkenyl ether sulfates, alkyl or alkenyl sulfates, olefinsulfonates, alkanesulfonates, saturated or unsaturated fatty acid salts, alkyl or alkenyl ether carboxylic acid salts, $\alpha$-sulfofatty acid salts or their esters, amino acid surfactants, N-acylamino acid surfactants, alkyl or alkenyl acid phosphates, and alkyl or alkenyl phosphates or their salts;

ampholytic surfactants such as carboxy- or sulfobetaine surfactants;

nonionic surfactants such as polyoxyalkylene alkyl or alkenyl ethers, polyoxyethylene alkylphenyl ethers, higher fatty acid alkanolamides or their alkylene oxide adducts, sucrose fatty acid esters, fatty acid glycerol monoesters and alkylamine oxides; and cationic surfactants such as quaternary ammonium salts.

Preferred surfactants include, for example, the straight chain or branched alkylbenzenesulfonates, alkyl or alkenyl ether sulfates, alkyl or alkenyl sulfates, olefinsulfonates, alkanesulfonates, saturated or unsaturated fatty acid salts, carboxy- or sulfobetaine surfactants, polyoxyalkylene alkyl or alkenyl ethers, polyoxyethylene alkylphenyl ethers and higher fatty acid alkanolamides or their salts.

The amount of the organic surfactant used is in the range of 20 to 60 wt. %, preferably 25 to 60 wt. %. When the amount thereof is less than 20 wt. %, no sufficient detergent capacity can be obtained and, on the contrary, when it exceeds 60 wt. %, the producibility and the physical properties of the obtained powdery detergent are deteriorated unfavorably.

Among the organic surfactants, particularly, the anionic surfactants form the viscous pasty phase easily in water and, therefore, they are easily adversely affected by the presence of a large amount of the water-soluble crystalline salts. Thus, particularly when the anionic surfactant was used as the main component, the dispersibility and solubility of the obtained detergent in cold water were insufficient. Therefore, the effects of the present invention are remarkable particularly when the anionic surfactant content of the organic surfactants is 70 wt. % or more.

Examples of the water-soluble, crystalline inorganic salts the content of which is limited in the present invention include alkali metal and ammonium chlorides, sulfates, hydrogensulfates, sulfites, hydrogensulfites, carbonates, hydrogencarbonates, sesquicarbonates, borates, inorganic phosphates (such as tripolyphosphates, pyrophosphates, high-molecular metaphosphates having a degree of polymerization of about 6 to 21, and orthophosphates) and silicates having a molar ratio of $SiO_2$ to the alkali metal oxide of 1.0 or less than as orthosilicates and metasilicates. Among them, sodium salts of the above-mentioned acids are preferred. Particularly, sodium carbonate, sulfate, tripolyphosphate, pyrophosphate and orthophosphate are preferred. Since the change in solubility of these salts according to the temperature is larger than that of other salts, they are easily crystallized from the aqueous solution and they have a relatively large amount of water of crystallization at a relatively low temperature and the crystals easily coalesce together to form a firm structure. Thus, these salts damage the dispersibility and solubility of the high-density detergent seriously. Among them, sodium carbonate which generates a large amount of heat upon hydration is dissolved out even in cold water to form a solution having a high concentration with the generation of heat. The heat is taken up by the surrounding low-temperature system. When the temperature is thus lowered, the solubility thereof is reduced seriously to precipitate crystals. At a temperature of 32° C. or below, sodium carbonate is in the form of its decahydrate and it has a large amount of water of crystallization. The volume of the undissolved crystals per se is also increased as the crystals are hydrated and the hydrated crystals more easily coalesce together to form a firmer structure. The sodium carbonate content is thus particularly limited.

The amount of the water-soluble, crystalline inorganic salts in the detergent stock of the present invention should be at least 2 wt. % from the viewpoint of the physical properties of the powdery detergent and 15 wt. % or less from the viewpoint of the solubility at a low temperature. When said salt is sodium carbonate, the amount thereof is controlled preferably to less than 10 wt. % from the above-mentioned reasons.

The detergent stock of the present invention contains also water-soluble, non-crystalline inorganic salts, builders such as water-insoluble, inorganic salts and other ordinary detergent components so as to improve the producibility and deterging capacity thereof.

Examples of these inorganic salts include inorganic builders such as silicates having a molar ratio of $SiO_2$ to an alkali metal salt of higher than 1.0 (such as Nos. 1, 2 and 3 sodium silicates) and aluminosilicates, e.g. type A zeolite. Organic sequestering agents for divalent metals may also be used. The amount of them is 25 to 78 wt. %.

The process for the preparation of the high-density granular detergent stock according to the present invention is not particularly limited. The stock can be prepared by, for example, a process disclosed in the specification of said Japanese Patent Laid-Open No. 61511/1973, a process wherein an alkali and an acid-resistant detergent component are added to a non-neutralized anionic surfactant to neutralize the same, then zeolite or the like is added thereto and the mixture is ground, or a process wherein a spray-dried powdery detergent is granulated to increase its bulk density.

The granule diameter of the high-density granular detergent stock is usually in the range of 40 to 2,000 μ, particularly 125 to 2,000 μ.

It has been found that a larger amount in total of the water-soluble, crystalline salts can be incorporated in the detergent when they are granulated and dry-blended with granules comprising other detergent components such as the organic surfactant to localize the former than when said salts are mixed homogeneously with other detergent components used in the present invention. More particularly, when the water-soluble, crystalline salts are incorporated uniformly in the detergent granules, these salts are dissolved out uniformly from the mass of the detergent granules when water penetrates into the mass. The temperature of the salts is lowered because its heat is removed by the surrounding low-temperature system and, as a result, crystals are precipitated. Thus, the crystals are formed in any portion in the pasty phase comprising the organic surfactant and the other detergent components to further harden the pasty phase and also to cause the coalescence of the crystals. On the contrary, according to the present invention wherein the water-soluble, crystalline, inorganic salts are used in granular form and dry-blended with the high-density granular detergent stock to localize the former in the latter, the low-temperature solubility of the detergent can be kept. In case a given total amount of the water-soluble, crystalline, inorganic salt is used, higher dispersibility and solubility can be obtained when it is dry-blended in granular form with the detergent stock than when it is incorporated homogeneously in the detergent stock.

According to the present invention, the deterging capacity equal to that of ordinary spray-dried detergent can be obtained by dry-blending 5 to 25 wt. % of the alkaline, water-soluble, crystalline, inorganic salt granules with the high-density granular detergent stock. In addition, the obtained high-density granular detergent composition has high dispersibility and solubility in cold water because it is prepared by the dry after-blend process. Even when the water-soluble, crystalline, inorganic salt content is less than 20 wt. %, the intended deterging capacity can be obtained by increasing the amounts of other inorganic builders and organic sequestering agent. However, the water-soluble, crystalline, inorganic salts are used desirably in an amount of at least 20 wt. %, since they are inexpensive. Among the above-mentioned water-soluble, crystalline inorganic salts, the alkaline, water-soluble, crystalline inorganic salts include, for example, sodium carbonate, tripolyphosphate, pyrophosphate and orthophosphate.

For the localization intended in the present invention, the diameter of the water-soluble, crystalline, inorganic salt granules to be dry-blended is preferably large. However, excessively large granules are not preferred, since the dissolution rate of such large granules per se is quite low and undesirable for the detergent. Thus, the average particle diameter is 100 to 1,000 μ, preferably 200 to 600 μ.

The bulk density of the granular inorganic salt is at least 0.5 g/cm$^3$, preferably at least 0.6 g/cm$^3$ and particularly equal to that of the detergent stock. When the difference in the bulk density between the detergent stock and the granular salt is excessive, the salt granules are localized excessively by the separation to form a portion in which the granular salt concentration is extremely high and in which the dispersibility and solubility of the detergent are very low. Further, when the diameter of the granular salt is insufficient, the granules are not localized sufficiently to damage the dispersibility and solubility of the detergent unfavorably like the case of the incorporation of a large amount thereof in the detergent stock.

The organic sequestering agents for divalent metals used in the present invention include, for example, phosphonates such as ethane-1,1-diphosphonates, phosphonocarboxylic acid salts such as 2-phosphonobutane-1,2-dicarboxylic acid salts, amino acid salts such as aspartic and glutamic acid salts, aminopolyacetates such as nitrilotriacetates and ethylenediamine tetraacetates, high-molecular electrolytes such as polyacrylic and polyaconitic acids, organic acid salts such as oxalates and citrates and polyacetalcarboxylic acid polymers and salts thereof as mentioned in the specification of Japanese Patent Laid-Open No. 52196/1979.

The invention provides a preferable embodiment (II) of the detergent composition which comprises (1) a high-density granular detergent stock containing organic surfactant(s) and inorganic salts wherein the amount of the organic surfactant(s) in the stock is 20 to 60 wt. %, that of a water-soluble, crystalline inorganic salt is 15 wt. % or less and that of other inorganic builders and/or organic sequestering agent(s) for divalent metals is 25 to 80 wt. % and (2) at least 5 wt. % of granular, water-soluble, crystalline inorganic salts carrying an organic substance capable of inhibiting dehydration, dry-blended with said stock.

According to the present invention, a deterging capacity equal to or higher than that of the ordinary spray-dried detergents can be obtained by dry-blending high-density granular detergent stock with the water-soluble, crystalline inorganic salt granules treated with an organic substance capable of inhibiting hydration such as a hydrophobic organic substance, e.g., a silicone; a nonionic surfactant, e.g., a polyoxyethylene, polyhydric alcohol or alkylolamide; or a polymer, e.g., polyethylene glycol. Any desired amount of the water-soluble, crystalline inorganic salts can be incorporated therein without reducing the dispersibility of solubility of the high-density granular detergent in cold water. Though the organic substance capable of inhibiting hydration can be used alone, it is desirable to use it in combination with other components, namely, in the form of granules prepared by supporting the organic substance capable of inhibiting hydration and having a melting point of 40° C. or below in the water-soluble, crystalline, inorganic salt and coating the surfaces of the obtained granules with the organic substance capable of inhibiting hydration and having a melting point above 40° C. (preferably above 50° C.). By this treatment, the following merits can be obtained: even when water penetrates into a mass of the detergent granules under application of no mechanical force, the water-soluble, crystalline inorganic salt is protected from hydration, since this salt carried said organic substance. Even when the hydration occurs, the organic substance surrounds the salt granules to inhibit the dissolution of the salt when no mechanical force is applied thereto. Therefore, the phenomena which are the main causes of the inhibition of the dispersion and dissolution, such as formation of crystals of the salt and caking due to the coalescence of the hydrated crystals do not occur. Further, by coating the surfaces of the granules with the latter organic substance having a melting point above 40° C. (preferably 50° C. or higher), the obtained granules have a high fluidity even when the former organic substance supported on the carrier has a low melting point. During the storage of the obtained product, the former organic substance supported by the inorganic salt hardly oozes out, the high fluidity of the granules is not deteriorated and the dispersibility and solubility of the product are not damaged as described above. The most desirable examples of the organic substances having a melting point of 40° C. or below to be supported by the granules include nonionic surfactants. The most desirable examples of the organic substances having a melting point above 40° C. (preferably at least 50° C.) used for coating the granule surfaces include polyethylene glycols having an average molecular weight of at least 2.000. The reasons therefor are that the nonionic surfactants have a remarkable effect of inhibiting the hydration and dissolution of the inorganic salts, because they are hydrated with a small amount of water when they are left to stand and that the polyethylene glycols easily form excellent coating films on the surfaces of the granules.

Processes for the preparation of the granules comprising the water-soluble, crystalline, inorganic salt having a melting point of 40° C. or below, the surfaces of which are coated with the organic substance having a melting point above 40° C. (preferably at least 50° C.), are not particularly limited according to the present invention. A preferred example of these processes is one disclosed in the specification of Japanese Patent Application No. 195667/1985 wherein a water-soluble, crystalline, inorganic salt anhydride in powdery form which does not substantially liberate water of crystallization at a temperature of below 50° C. is previously mixed with an organic substance having a melting point of 40° C. or below at a temperature above the melting point of the organic substance and then the mixture is stirred together with an aqueous solution of an organic substance having a melting point above 40° C. (preferably at least 50° C). In this process, water in the latter aqueous solution of the organic substance is used as water of crystallization of the inorganic salt and coating films of the latter organic substance are formed on the granule surfaces to form the detergent granules having high fluidity and storage stability. The fluidity can be improved further by mixing the obtained granules with 0.2 to 10 wt. %, based on the granules, of a finely divided powder having the average diameter of the primary particles of 5 μm or less (such as fine powder of an aluminosilicate, e.g., type A zeolite). The amount of the former organic substance in the granules varies depending on the shape of the granules of the water-soluble, crystalline, inorganic salts. When the granules have a small average diameter or they are porous, the amount of the organic substance contained therein can be increased. The most desirable examples of the former organic substances include nonionic surfactants such as polyoxyethylene, polyhydric alcohol and alkylolamide nonionic surfactants. The amount of the former organic substance is preferably, one which corresponds to an oil absorption of 80% or less based on the water-soluble, crystalline, inorganic salt powder as determined by the test method 6.1.2. of carbon black for rubbers according to JIS K 6221. The most desirable examples of the latter organic substances are polyethylene glycols and those having an average molecular weight of 2,000 or higher can be obtained. From these viewpoints, the amount of the former organic substance in the granules is 1 to 20 wt. %, preferably 3 to 10 wt. % and that of the latter organic substance is 2 to 20 wt. %, preferably 6 to 15 wt. %. Polyethylene glycols having a molecular weight lower than that mentioned above are not preferred, since they have a low melting point and, therefore, when they are exposed to a high temperature in the course of the storage, they are molten to cause caking. Polyethylene glycol is used preferably in the form of 40 to 95 wt. % aqueous solution thereof. When the polyethylene glycol is used in the form of its aqueous solution, the amount of water therein is controlled preferably to be in the range of 0.1 to 1.1 times as much as that of water of crystallization of the water-soluble, crystalline inorganic salt. A larger amount of water is undesirable, since superfluous energy and time are necessitated in the drying step.

The granules thus treated and kept from the hydration are incorporated by dry-blending in the high-density detergent stock in an amount of usually at least 5 wt. %, preferably at least 15 wt. % and particularly 15 to 35 wt. %.

The invention provides another preferable embodiment (III) of the composition, having high dispersibility and solubility in cold water, which comprises (a) organic surfactant(s), (b) water-soluble, crystalline inorganic salt(s), (c) other inorganic salt(s) and/or organic sequestering agent(s) for divalent metals and (d) other components, characterized in that the amount of the component(s) (a) is 20 to 60 wt. %, that of the component(s) (b) is 2 to 15 wt. % and that of the component(s) (c) is 25 to 78 wt. %, that the component (b) contains at least 2 wt. % of an alkaline inorganic salt and that the total amount of the alkaline inorganic salts is at least 20 wt. % based on the composition.

The composition of the present invention contains at least 2 wt. % of an alkaline, water-soluble, crystalline inorganic salt as an indispensable component for improving the deterging power and physical properties of the powder. The alkaline inorganic salts include, for example, sodium carbonate, tripolyphosphate, pyrophosphate and orthophosphate among the above-mentioned water-soluble, crystalline inorganic salts. As described above, the amount of the water-soluble, crystalline inorganic salt is limited to 15 wt. % or less in the present invention so as not to reduce the low-temperature solubility. Particularly when the alkaline inorganic salt is sodium carbonate, the amount thereof should be controlled to less than 10 wt. % for the above-mentioned reasons.

The total amount of the alkaline inorganic salts including the water-soluble, crystalline ones, other alkaline inorganic salts and organic sequestering agents such as zeolite is at least 20 wt. %. When said total amount is less than 20 wt. %, the deterging power required of the detergent cannot be exhibited easily.

The invention will be explained in view of the component (e). It is preferably noted that the particles of an inorganic builder carrying thereon a nonionic surfactant, having been coated with polyethylene glycol have a high fluidity and that the nonionic surfactant does not substantially ooze out during the storage. The present invention has been completed on the basis of this finding.

The present invention relates to a composition for powdery detergent characterized by comprising particles of a nonionic surfactant-carrying organic or inorganic substance the surfaces of which are coated with polyethylene glycol.

The composition for powdery detergent of the present invention can be prepared by, for example, the following process: a powdery organic or inorganic anhydride which does not substantially liberate water of crystallization at a temperature of not higher than 50° C. or is mixed with a nonionic surfactant at a temperature of not lower than the melting point of the nonionic surfactant and the obtained mixture is stirred together with an aqueous solution of polyethylene glycol (hereinafter referred to as PEG). Water is thus taken out as water of crystallization of the organic or inorganic compound and a coating film of PEG is formed on the surface of each particle.

Examples of the organic builders used in the present invention include citric acid and alkali metal salts thereof, sodium succinate, tartaric acid and sodium p-toluenesulfonate. Examples of the inorganic builders include sodium tripolyphosphate, sodium pyrophosphate, potassium pyrophosphate, sodium phosphate, sodium carbonate, sodium tetraborate, magnesium sulfate and sodium aluminosilicate. These builders may be used either alone or in the form of a mixture of them in a desired ratio. As a matter of course, a combination of compounds which react chemically with each other, such as a combination of citric acid and sodium carbonate (neutralization reaction occurs between them) is unsuitable. The amount of the nonionic surfactant varies depending on the shape of the particles of the builder component. When the particles having a small average diameter or porous particles are used, the nonionic surfactant can be used in a large amount. Particularly porous sodium carbonate particles having a bulk density of 0.4 to 1.0 g/ml and an average particle diameter of 200 to 1000 μm are suitable for this purpose. Such sodium carbonate particles can be prepared by, for example, a process disclosed in the specification of Japanese Patent Laid-Open No. 190216/1984.

The powder thus obtained may further contain 50% or less of a powdery compound free of water of crystallization, such as fine powder of silicon dioxide or a powdery sodium alkyl sulfate.

The nonionic surfactants used in the present invention may be polyoxyethylene, polyhydric alcohol and alkylolamide surfactants. The relative amount of the nonionic surfactant to said organic or inorganic anhydride powder is such that it corresponds to 80% or less of the oil absorption determined by the test method 6.1.2. of carbon black for rubbers according to JIS K 6221.

PEG used preferably in the present invention has an average molecular weight of at least 2,000. PEG having a molecular weight of less than 2,000 is unsuitable, since it has a low melting point and, therefore, when it is exposed to a high temperature during the storage, it is molten to cause caking. To form the PEG coating film on the surface of each builder particle carrying the nonionic surfactant, both PEG and builder carrying the nonionic surfactant are heated to 60° C. or above and mixed together and the mixture is cooled rapidly. For this purpose, a fluidized bed system is preferred. A great characteristic feature of the present invention is that PEG can be used in the form of a 40 to 95 wt. % aqueous solution thereof. In such a case, it is heated until the aqueous PEG solution in liquid form is obtained and heating of the builder carrying the nonionic surfactant is unnecessary. When the aqueous PEG solution is used, the amount thereof is controlled preferably so that the amount of water in the aqueous solution is in the range of 0.1 to 1.1 times as much as that of water of crystallization of the organic or inorganic anhydride. A larger amount of water is undesirable, since superfluous energy and time are necessitated in the drying step.

According to the present invention, the above-mentioned organic or inorganic anhydride is mixed well with the nonionic surfactant at a temperature of not lower than the melting point of the nonionic surfactant. When the builder is porous, it is impregnated well with the nonionic surfactant. Then, PEG or its aqueous solution is added to the mixture and mixed together under cooling and pulverized. In the formation of the PEG coating film on the particle surface, it is important that the mixture to be treated is kept from kneading as far as possible until PEG is solidified by either or both of lowering of the temperature of the mixture or(and) reduction in water content of the aqueous PEG solution due to the hydration of the builder component.

Though the product thus treated has a sufficient fluidity already, the fluidity can be further increased by adding 0.2 to 10 wt. % of a fine powder having an average diameter of the primary particle of 5μ or smaller.

In addition, the following components can also be incorporated in suitable amounts, if necessary, in the composition of the present invention:

(1) antiredeposition agents:

polyethylene glycol, polyvinyl alcohol, polyvinylpyrrolidone and carboxymethylcellulose, and (2) bleaching agents, fluorescent dyes, enzymes, etc.:

bleaching agents such as sodium percarbonate, sodium perborate, sodium sulfate/sodium chloride/hydrogen peroxide adduct and commercially available fluorescent dyes; flavors; enzymes such as protease, amylase, lipase and cellulase; bluing agent; and bleaching activators.

The following examples will further illustrate the present invention, which by no means limit the invention.

EXAMPLE 1

High-density granular detergent stocks (A) having the compositions shown in Table 1 were prepared. Granules of a water-soluble, crystalline salt (B) shown in Table 2 were dry-blended with (A) to obtain high-density granular detergents. The bulk density, dispersibility and solubility of them were determined to obtain the results shown in Table 2.

TABLE 1

Compositions of high-density granular detergent stocks (A)

| Composition | | (wt. %) Composition 1 | Composition 2 | Composition 3 |
|---|---|---|---|---|
| (P) | (a) LAS | 30 | 25 | 20 |
| | AS | 9 | 7.5 | 6 |
| | AES | 3 | 2.5 | 2 |
| | AOS | 3 | 2.5 | 2 |
| | Soap | 3 | 2.5 | 2 |
| | Nonionic | 3 | 2.5 | 2 |
| | Zeolite (4A) | 15 | 15 | 15 |
| | No. 2 Sodium silicate | 7 | 7 | 7 |
| | Polyethylene glycol | 2 | 2 | 2 |

TABLE 1-continued

Compositions of high-density granular detergent stocks (A)

| Composition | | (wt. %) Composition 1 | Composition 2 | Composition 3 |
|---|---|---|---|---|
| | (b) Sodium carbonate | 0 | 8.5 | 17 |
| | Sodium sulfate | 4 | 4 | 4 |
| | Minor additives | 3 | 3 | 3 |
| | Water | balance | balance | balance |
| (Q) | Zeolite (4A) | 10 | 10 | 10 |
| | Water | 2 | 2 | 2 |
| (R) | Zeolite (4A) | 3 | 3 | 3 |

(a) Organic surfactants:
LAS: Sodium straight chain alkylbenzenesulfonates ($C_{12}$ to $C_{13}$)
AS: Sodium alkyl sulfates ($C_{14}$ to $C_{15}$)
AES: Sodium polyoxyethylene alkyl sulfates
($C_{14}$ to $C_{15}$, $\overline{EO}$ = 1.5)
AOS: Sodium α-olefinsulfonates ($C_{16}$ to $C_{18}$)
Nonionic: Polyoxyethylene alkyl ethers
($C_{12}$ to $C_{13}$, $\overline{EO}$ = 10)
(b) Water-soluble, crystalline inorganic salts.

In Table 1, the compounds (a) are organic surfactants and the compounds (b) are water-soluble, crystalline inorganic salts used in the limited amount according to the present invention. Polyethylene glycol having an average molecular weight of about 13,000 used in the above operation was the dispersant and it was not included in the organic surfactants (a). Further, zeolite and No. 2 sodium silicate are not included in the water-soluble, crystalline salts (b), since the former is water-insoluble and the latter is amorphous and does not form the crystals from its aqueous solution.

Now, the description will be made on the preparation and determination methods of the bulk density and dispersibility solubility of the high-density granular detergent. The following preparation process is nothing but a preferred embodiment of the process for preparing the high-density granular detergent used in Example 1, which by no means limit the invention.

(1) Process for the preparation of the detergent:

Slurries comprising the compositions (P) shown in Table 1 and having a water content of 50 wt. % were prepared and spray-dried to obtain powdery detergents (P) having a bulk density of around 0.3 g/cm$^3$. Each of the products was placed in a high-speed mixer (an agitated tumbling granulator; a product of Fukae Kogyo Co., Ltd.). A composition (Q) comprising fine zeolite powder wetted with water was added thereto and the mixture was ground and granulated to obtain a high-density granular detergent having a bulk density of 0.6 to 0.8 g/cm$^3$. In this step, water in the composition (Q) acted as a binder for the granulation of the ground detergent powder (P) and the fine zeolite powder in the composition (Q) acted as (1) a carrier of water acting as the granulation binder and (2) a granulation assistant for inhibiting the formation of coarse granules. The nonionic surfactant in the composition (P) may be used also as the granulation binder by spraying it in liquid form on the detergent powder in the granulation step. Finally, the fine zeolite powder (R) and granules of the water-soluble, crystalline salt (B) were dry-blended with the obtained high-density granular detergent (P)+(Q) to obtain a high-density granular detergent having excellent fluidity and caking stability. Thermally unstable minor additives such as enzymes and bleaching agents are dry-mixed therein in the final step to obtain a preferred composition. In this example, the product was passed through a screen having an aperture of 1 mm to remove coarse granules having a diameter of 1 mm or above after the grinding and granulation. According to this process, the granular detergent having a desired bulk density and granule size can be obtained by controlling the grinding/granulation conditions (such as kind of the granulating machine, granulation temperature, granulation time and kind of the granulation binder) and the aperture of the screen through which the granules are passed after the granulation and recycling of the coarse granules or by controlling the amount, bulk density and granule size of the water-soluble, crystalline salt (B) to be dry-blended.

(2) Determination of the bulk density (apparent specific gravity) of the detergent:

The bulk density was determined according to a process of JIS K-3362.

(3) Determination of the dispersibility and solubility of the detergent:

Aozora PF-2650 (a fully automatic washing machine for 2.8 kg of washing; a product of Hitachi, Ltd.) was used. A mass of 40 g of the detergent was placed at an end of the bottom of the machine. 2 kg of clothes (60 parts by weight of cotton underwears and 40 parts by weight of outing shirts made of a blended fiber of polyester and cotton) were placed thereon. 8 l/min of city water at a given temperature was poured therein slowly in a total amount of 40 l in 5 min in such a manner that water was not poured directly on the detergent. Then, agitation was begun. After 3 min, the agitation was stopped, followed by draining and dehydration for 3 min. The detergent remaining on the clothes and in the washing tank was observed visually and the results were judged according to the following criteria:

○: No detergent remained.

Ⓐ : Only a small amount of small granules of the detergent remained.

Δ: A lot of small granules of the detergent or a small amount of masses of the detergent remained.

x: A considerable amount of masses of the detergent remained.

In this determination process, the mass of the detergent granules was exposed to water while substantially no physical or mechanical force was applied thereto in the step of pouring water for 5 min and then the mechanical stirring force was applied thereto.

EXAMPLE 2

High-density granular detergent stocks (A) having the compositions shown in Table 3 were prepared. Granules of a water-soluble, crystalline salt (B) were dry-blended with (A) to obtain high-density granular detergents. The bulk density dispersibility and solubility of them were determined.

The process for the preparation of the detergents and the determination processes were the same as in Example 1. The results are shown in Table 4.

TABLE 2

| | | Results | | | | | | | |
|---|---|---|---|---|---|---|---|---|---|
| | | Experiment No. | | | | | | | |
| | | 1 (present invention) | 2 (present invention) | 3 (comparative) | 4 (present invention) | 5 (present invention) | 6 (comparative) | 7 (comparative) | 8 (comparative) |
| High-density granular detergent stock (A) | Composition of (A) | composition 1 | ← | ← | compostion 2 | ← | ← | composition 3 | ← |
| | Amount of organic surfactant (a) in (A) (wt. %) | 51.0 | ← | ← | 42.5 | ← | ← | 34.0 | ← |
| | Amount of anionic surfactant in (a) (wt. %) | 94.1 | ← | ← | 94.1 | ← | ← | 94.1 | ← |
| | Amount of water-soluble, crystalline salts (b) in (A) (wt. %) | 4.0 | ← | ← | 12.5 | ← | ← | 21.0 | ← |
| | Bulk density of (A) ($g/cm^3$) | 0.62 | ← | ← | 0.71 | ← | ← | 0.70 | ← |
| Water-soluble, crystalline salt granules (B) | Component (B) | sodium carbonate | ← | ← | sodium tripolyphosphate | ← | ← | none | sodium carbonate |
| | Bulk density of (B) ($g/cm^3$) | 1.13 | ← | ← | 1.05 | ← | ← | — | 1.13 |
| | Average granule diameter of (B) ($\mu$) | 327 | ← | ← | 159 | ← | ← | — | 327 |
| Dry-blending weight ratio of (A)/(B) | | 90/10 | 80/20 | 70/30 | 90/10 | 80/20 | 70/30 | 100/0 | 90/10 |
| Final bulk density of detergent ($g/cm^3$) | | 0.65 | 0.69 | 0.73 | 0.68 | 0.72 | 0.76 | 0.70 | 0.73 |
| Dispersibility and solubility | City water at 5° C. | ○ | Ⓐ | X | Ⓐ | Ⓐ | X | X | X |
| | City water at 10° C. | ○ | ○ | X | ○ | ○ | X | X | X |

TABLE 3

| Compositions of high-density granular detergent stocks (A) (wt. %) | | | |
|---|---|---|---|
| | Composition | Composition 4 | Composition 5 |
| | (a) LAS | 22 | 22 |
| | AS | 6 | 6 |
| | AES | 2 | 2 |
| | AOS | 3 | 3 |
| | Soap | 4 | 4 |
| | N-3 onionic | 3 | |
| (P) | Zeolite (4A) | 15 | 10 |
| | No. 2 sodium silicate | 8 | 4 |
| | Polyethylene glycol | 2 | 2 |
| | (b) Sodium carbonate | 6 | 15 |

TABLE 3-continued

| Compositions of high-density granular detergent stocks (A) (wt. %) | | Composition 4 | Composition 5 |
|---|---|---|---|
| | Sodium sulfate | 6 | 6 |
| | Minor additives | 3 | 3 |
| | Water | balance | balance |
| (Q) | Zeolite (4A) | 10 | 10 |
| | Water | 2 | 2 |
| (R) | Zeolite (4A) | 3 | 3 |

*2: Sodium carbonate prepared by a process disclosed in the specification of Japanese Patent Laid-Open No. 190216/1984 and having a bulk density of 0.56 g/cm$^3$ and an average granular diameter of 550° μ.

The compositions shown in Table 5 were each prepared in the same manner as shown in Example 1, except that polyethylene glycol and water in the granule (B) were used in the form of a 60 wt. % aqueous solution of polyethylene glycol and the granule (B) was dry-blended with the stock (A) finally.

The granules (B) having the composition 2, 5, 6 or 7 used in the examples of the present invention were prepared by placing the water-soluble, crystalline, anhydrous, inorganic salt granules (b) in a V-blender (P-K twin-shell laboratory Blender, 8QT. Liquid-solid model, PATTERSON-KELLEY Co., U.S.A.), adding the nonionic surfactant thereto through a liquid feeder of the V-blender, mixing them for 3 min, adding a previously prepared 60 wt. % aqueous solution of polyethylene glycol (average molecular weight: about 13,000), mixing them for 5 min, adding a fine powder of zeolite to the mixture and mixing them for 30 sec to obtain the granules (B) having high fluidity and caking stability.

TABLE 4

| Results | | Experiment No. 9 (present invention) | 10 (present invention) | 11 (present invention) | 12 (comparative) | 13 (present invention) | 14 (comparative) | 15 (comparative) | 16 (comparative) |
|---|---|---|---|---|---|---|---|---|---|
| High-density granular detergent stock (A) | Composition of (A) | composition 4 | ← | ← | ← | ← | ← | composition 5 | ← |
| | Amount of organic surfactant (a) in (A) (wt. %) | 40 | ← | ← | ← | ← | ← | 40 | ← |
| | Amount of anionic surfactant in (a) (wt. %) | 92.5 | ← | ← | ← | ← | ← | 92.5 | ← |
| | Amount of water-soluble, crystalline salts (b) in (A) (wt. %) | 12 | ← | ← | ← | ← | ← | 21 | ← |
| | Bulk density of (A) (g/cm$^3$) | 0.76 | ← | ← | ← | ← | ← | 0.74 | ← |
| Water-soluble, crystalline salt granules (B) | Component (B) | sodium carbonate | ← | ← | ← | sodium tripolyphosphate | ← | none | sodium carbonate |
| | Bulk density of (B) (g/cm$^3$) | 1.13 | ← | 0.61 | 1.13 | 1.05 | ← | — | 1.13 |
| | Average granule diameter of (B) (μ) | 327 | ← | 548 | 327 | 201 | ← | — | 327 |
| Dry-blending weight ratio of (A)/(B) | | 95/5 | 85/15 | 85/15 | 70/30 | 85/15 | 70/30 | 100/0 | 85/15 |
| Final bulk density of detergent (g/cm$^3$) | | 0.76 | 0.80 | 0.74 | 0.85 | 0.79 | 0.83 | 0.74 | 0.78 |
| Dispersibility and solubility | City water at 5° C. | ○ | ◎ | ○ | X | ◎ | X | X | X |
| | City water at 10° C. | ○ | ○ | ○ | X | ○ | X | X | X |

EXAMPLE 3

High-density granular detergent stocks (A) and granules (B) having the compositions shown in Table 5 were prepared and (A) and (B) were dry-blended together. The bulk density, dispersibility and solubility of them were determined to obtain the results shown in Table 6.

Additional explanation about Table 5 is shown below.

*1: Soda ash according to JIS K-1201 having a bulk density of 1.13 g/cm$^3$ and an average granule diameter of 327 μ.

TABLE 5

| Composition of high-density granular detergent stocks | | | Compn. 1 | Compn. 2 | Compn. 3 | Compn. 4 | Compn. 5 | Compn. 6 | Compn. 7 |
|---|---|---|---|---|---|---|---|---|---|
| Composition of high density granular stock (A) | (P) | (a) LAS | 25 | 25 | 20 | 20 | 20 | 20 | 20 |
| | | AS | 7 | 7 | 5 | 5 | 5 | 5 | 5 |
| | | AES | 2 | 2 | 0 | 0 | 0 | 0 | 0 |
| | | AOS | 2 | 2 | 0 | 0 | 0 | 0 | 0 |
| | | Soap | 3 | 3 | 3 | 3 | 3 | 3 | 3 |
| | | Nonionic | 2 | 1 | 3 | 3 | 2 | 1 | 0 |
| | | Zeolite (4A) | 9 | 8 | 8 | 8 | 7 | 6 | 6 |
| | | No. 2 sodium silicate | 5 | 5 | 6 | 6 | 6 | 6 | 6 |
| | | Polyethylene glycol | 2 | 0.5 | 3 | 3 | 1.5 | 1.5 | 1.5 |
| | | (b) Sodium carbonate | 17 | 2 | 30 | 8 | 7 | 6 | 6 |
| | | Sodium sulfate | 4 | 4 | 4 | 4 | 4 | 4 | 4 |
| | | Minor additives | 3 | 3 | 3 | 3 | 3 | 3 | 3 |
| | | Water | balance | balance | balance | balance | balance | balance | balance |

TABLE 5-continued

| Composition | | Composition of high-density granular detergent stocks | | | | | | |
|---|---|---|---|---|---|---|---|---|
| | | Compn. 1 | Compn. 2 | Compn. 3 | Compn. 4 | Compn. 5 | Compn. 6 | Compn. 7 |
| | (Q) Zeolite (4A) | 10 | 10 | 7.5 | 7.5 | 7.5 | 7.5 | 7.5 |
| | Water | 2 | 2 | 1.5 | 1.5 | 1.5 | 1.5 | 1.5 |
| | (R) Zeolite (4A) | 3 | 3 | 2 | 2 | 2 | 2 | 2 |
| Composition of granules (B) | (b) Sodium carbonate (heavy ash)*1 | 0 | 15 | 0 | 30 | 15 | 30 | 0 |
| | Sodium carbonate (porous)*2 | 0 | 0 | 0 | 0 | 0 | 0 | 30 |
| | Nonionic | 0 | 1 | 0 | 0 | 1 | 2 | 3 |
| | Polyethylene glycol | 0 | 1.5 | 0 | 0 | 1.5 | 3 | 3 |
| | Water | 0 | 1 | 0 | 0 | 1 | 2 | 2 |
| | Zeolite (4A) | 0 | 1 | 0 | 0 | 1 | 2 | 2 |

TABLE 6

| Item | Detergent composition | (results) Compn. 1 (Comparative) | Compn. 2 (Present invention) | Compn. 3 (Comparative) | Compn. 4 (Comparative) | Compn. 5 (Comparative) | Compn. 6 (Present invention) | Compn. 7 (Present invention) |
|---|---|---|---|---|---|---|---|---|
| High-density granular detergent stock (A) | Amount of organic surfactant (a) in (A) (wt. %) | 41.0 | 49.7 | 31.0 | 44.3 | 37.3 | 47.5 | 46.7 |
| | Amount of anionic surfactant in (a) (wt. %) | 95.1 | 97.5 | 90.3 | 90.3 | 93.3 | 96.6 | 100.0 |
| | Amoung of water-soluble, crystalline salts (b) in (A) (wt. %) | 21.0 | 7.5 | 34.0 | 5.7 | 23.6 | 6.6 | 6.7 |
| | Bulk density of (A) (g/cm$^3$) | 0.71 | 0.66 | 0.78 | 0.65 | 0.73 | 0.66 | 0.67 |
| Granules (B) | Bulk density of (B) (g/cm$^3$) | — | 0.95 | — | 1.13 | 0.95 | 0.95 | 0.85 |
| | Average granular diameter of (B) (μ) | — | 363 | — | 327 | 363 | 363 | 555 |
| Total amount of water-soluble, crystalline inorganic salts (b) in the final detergent (wt. %) | | 21.0 | 21.0 | 34.0 | 34.0 | 34.0 | 34.0 | 34.0 |
| Bulk density of final detergent (g/cm$^3$) | | 0.71 | 0.72 | 0.78 | 0.79 | 0.77 | 0.77 | 0.74 |
| Dispersity and solubility | City water at 5° C. | X | O | X | X | X | Ⓐ | O |
| | City water at 10° C. | X | O | X | X | X | O | O |

It is apparent from the results shown above that, though the amount of the water-soluble, crystalline inorganic salts (b) in the final detergent composition 1 was equal to that of the final detergent composition 2, the composition 1 had neither the desired dispersibility nor solubility, since the amount of the water-soluble, crystalline inorganic salts (b) in the high-density granular detergent stock (A) was excessive.

On the other hand, the composition 2 had high dispersibility and solubility, since the amount of the water-soluble, crystalline inorganic salts (b) was limited and they were dry-blended with the balance of the granules (B) subjected to a hydration inhibition treatment according to the present invention.

Though the final detergent compositions 3, 4, 5, 6 and 7 contained the same amount of the water-soluble, crystalline inorganic salts (b), the compositions 3 and 5 had only low dispersibility and solubility, since the detergent stock (A) of each of them contained an excessive amount of the water-soluble, crystalline inorganic salt granules (b).

The compositions 4, 6 and 7 contained each a limited amount of the water-soluble, crystalline inorganic salts (b) in the detergent stock (A) according to the present invention. Among them, the composition 4 contained a large amount of the balance of the untreated salt granules (B) and, therefore, had poor dispersibility and solubility. On the contrary, compositions 6 and 7 prepared by dry-blending of the granules (B) subjected to the hydration-inhibition treatment according to the present invention had high dispersibility and solubility even though they contained a large amount of the water-soluble, crystalline inorganic salt (b). As compared with the composition 6, the composition 7 could carry a larger amount of the low-melting organic substance more stably, since the porous granules were used as the water-soluble, crystalline inorganic salt granules in the hydration inhibition-treated granules (B). Therefore, the granules (B) had a higher hydration-inhibition effects. Accordingly, the composition 7 had higher dispersibility and solubility than those of the composition 6.

EXAMPLE 4

High density granular detergents having the compositions shown in Table 7 were prepared and the bulk density and dispersibility and solubility of them were determined to obtain the results shown in Table 8.

The compositions shown in Table 7 were each prepared in the same manner as shown in Example 1, except that the granule (B) was not used, and examined in the same way as in Example 1.

Thus, when the amount of (b) was increased while the total amount of (a)+(b) and the amount of the surfactant in (a) were kept constant, the dispersibility and solubility of the detergent were reduced significantly. The effects of the present invention obtained by limiting the amount of (b) are thus apparent.

TABLE 7

| Detergent compositions | | (wt. %) | | |
|---|---|---|---|---|
| | Composition | Composition 1 | Composition 2 | Composition 3 |
| | (a) LAS | 28 | 25 | 20 |
| | AS | 8.4 | 7.5 | 6 |
| | AES | 2.8 | 2.5 | 2 |
| | AOS | 2.8 | 2.5 | 2 |
| | Soap | 2.8 | 2.5 | 2 |
| | Nonionic | 2.8 | 2.5 | 2 |
| (P) | Zeolite (4A) | 15 | 15 | 15 |
| | No. 2 sodium silicate | 7 | 7 | 7 |
| | Polyethylene glycol | 2 | 2 | 2 |
| | (b) Sodium carbonate | 3.4 | 8.5 | 17 |
| | Sodium sulfate | 4 | 4 | 4 |
| | Minor additives | 3 | 3 | 3 |
| | Water | balance | balance | balance |
| (Q) | Zeolite (4A) | 10 | 10 | 10 |
| | Water | 2 | 2 | 2 |
| (R) | Zeolite (4A) | 3 | 3 | 3 |

TABLE 8

| | | Results | | |
|---|---|---|---|---|
| | | Experiment No. | | |
| | | Composition 1 (present invention) | Composition 2 (present invention) | Composition 3 (comp. product) |
| Organic surfactant (a) (wt. %) | | 47.6 | 42.5 | 34.0 |
| Anionic surfactant in (a) (wt. %) | | 94.1 | 94.1 | 94.1 |
| Water-soluble, crystalline salts (wt. %) | | 7.4 | 12.5 | 21.0 |
| Bulk density of detergent ($g/cm^3$) | | 0.62 | 0.71 | 0.70 |
| Dispersibility and solubility | City water at 5° C. | ○ | Ⓐ | x |
| | City water at 10° C. | ○ | ○ | x |

EXAMPLE 5

High-density granular detergents having the compositions shown in Table 9 were prepared and the bulk density and dispersibility and solubility of them were determined.

The process for the preparation of the detergents and the determination processes were the same as in Example 4. Results are shown in Table 10.

TABLE 9

| Detergent compositions | | (wt. %) | |
|---|---|---|---|
| | Composition | Composition 4 | Composition 5 |
| | (a) LAS | 22 | 22 |
| | AS | 6 | 6 |
| | AES | 2 | 2 |
| | AOS | 3 | 3 |
| | Soap | 4 | 4 |
| | Nonionic | 3 | 3 |
| (P) | Zeolite (4A) | 15 | 10 |
| | No. 2 sodium silicate | 8 | 4 |
| | Polyethylene glycol | 2 | 2 |
| | (b) Sodium carbonate | 6 | 15 |
| | Sodium sulfate | 6 | 6 |
| | Minor additives | 3 | 3 |
| | Water | balance | balance |
| (Q) | Zeolite (4A) | 10 | 10 |
| | Water | 2 | 2 |
| (R) | Zeolite (4A) | 3 | 3 |

TABLE 10

| | | Results | |
|---|---|---|---|
| | | Experiment No. | |
| | | Composition 4 (present invention) | Composition 5 (comp. product) |
| Organic surfactant (a) (wt. %) | | 40 | 40 |
| Anonic surfactant in (a) (wt. %) | | 92.5 | 92.5 |
| Water-soluble, crystalline salts (wt. %) | | 12 | 21 |
| Bulk density of detergent ($g/cm^3$) | | 0.76 | 0.74 |
| Dispersibility and solubility | City water at 5° C. | ○ | x |
| | City water at 10° C. | ○ | x |

Thus, the effects of the present invention obtained by limiting the amount of (b) were apparent also When the amount of the organic surfactant (a) was kept constant and the amount of the watersoluble, crystalline organic salts (b) in the builder was varied, like in Example 9.

EXAMPLE 6

1.5 kg of light ash (soda ash according to JIS K 1201), 1.5 kg of sodium tripolyphosphate (according to JIS K 1465) and 60 g of a fluorescent dye (Tinopal CBS-X; a product of Ciba Geigy) were placed in a V-blender (P-K twin shell laboratory blender, 8QT. liquid-solid model, PATTERSON-KELLEY Co., L.S.A.). After mixing for 3 min, 375 g of a nonionic surfactant (Softanol 90; a product of Nippon Shokubai Kagaku Co., Ltd.) was added thereto through a liquid feeder of the V-blender. After mixing for 3 min, 450 g of a 60 wt. % aqueous solution of PEG (PEG #6,000; a product of Nippon Oils & Fats Co., Ltd.) prepared previously was added thereto and mixed for 5 min. Finally, 120 g of fine powder of sodium aluminosilicate (Toyo Builder; a product of Toyo Soda Mfg. Co., Ltd.) was added thereto and mixed for 30 sec. The obtained mixture was taken out of the V-blender. The sample was in the form of a powder having a high fluidity and a temperature of 36° C. (room temperature: 25° C.). After the sample was left to cool, it was not caked.

EXAMPLE 7

2.1 kg of porous sodium carbonate (having a bulk density of 0.56 g/ml and an average particle diameter of 550 μm; prepared by a process disclosed in the specification of Japanese Patent Laid-Open No. 190216/ 1984) was placed in the same V-blender as in Example 6. Then, 600 g of a nonionic surfactant (Softanol 90) was added thereto through a liquid feeder of the V-blender and mixed for 3 min. Then, 300 g of a 60 wt. % aqueous solution of PEG (PEG #6,000; a product of Nippon Oils & Fats Co., Ltd.) prepared previously was added thereto and mixed for 5 min. Finally, 90 g of fine powder of sodium aluminosilicate (Toyo Builder) was added thereto and mixed for 30 sec. The obtained mixture was taken out of the V-blender in the form of a powder having a high fluidity and a temperature of 37° C. (room temperature: 25° C.). After the sample was left to cool, it was not caked.

EXAMPLE 8

3 kg of heavy ash (soda ash according to JIS K 1201) was placed in the same V-blender as in Example 6. 225 g of a nonionic surfactant (Emulgen 910. a product of Kao Kagaku Co., Ltd.) was added thereto. After mixing for 3 min, 375 g of a 60 wt. % aqueous solution of PEG (PEG #6,000; a product of Nippon Oils & Fats Co., Ltd.) prepared previously was added thereto. After mixing for 4 min, 75 g of fine powder of sodium aluminosilicate (Toyo Builder) was added thereto finally. After mixing for 30 sec, the product was taken out of the V-blender. The sample thus obtained was in the form of a powder having a high fluidity and a temperature of 33° C. (room temperature: 25° C.). After the sample was left to cool, it was not caked.

15 wt. % of this sample was mixed with 85 wt. % of a spray-dried detergent having the following composition and the mixture was subjected to the tests described below.

| Composition of spray-dried stock | |
|---|---|
| sodium (straight-chain alkyl)—benzenesulfonate | 28% |
| sodium tripolyphosphate | 30 |
| sodium silicate (No. 2) | 7 |
| carboxymethylcellulose | 1 |
| Tinopal CBS-X | 0.1 |
| Glauber's salt | 27.9 |
| water | 6 |

COMPARATIVE EXAMPLE 1

A mixture of the nonionic surfactant and an aqueous PEG solution prepared previously was added to a mixture of the light ash, sodium tripolyphosphate and fluorescent dye in the same manner as in Example 6. After mixing for 5 min, 120 g of fine powder of sodium aluminosilicate was added thereto finally. After mixing for 30 sec, the product was taken out of the V-blender. The sample thus obtained was in the form of a powder having a relatively low fluidity and a temperature of 36° C. (room temperature: 25° C.). After the sample was left to cool, it was wholly caked.

COMPARATIVE EXAMPLE 2

330 g of the heavy ash was mixed with 2 kg of the spray-dried detergent in the V-blender for 30 sec in the same manner as in Example 8. Then, 21 g of the nonionic surfactant was added thereto. After mixing for 1 min, the product was taken out of the blender.

Tests:

The bulk densities, fluidities and degrees of oozing out of the nonionic surfactants in the samples obtained in the above Examples 6 to 8 and Comparative Examples 1 and 2 were examined.

Results are shown in Table 11.

TABLE 11

| | Bulk density (g/ml) | Fluidity (sec) | Oozing out |
|---|---|---|---|
| Example 6 | 0.85 | 6.4 | none |
| Example 7 | 0.85 | 6.0 | none |
| Example 8 | 0.31 | 6.0 | none |
| Comp. Ex. 1 | 0.80 | 7.9 | observed |
| Comp. Ex 2 | 0.33 | 7.2 | observed |

The fluidity of the sample was defined by a time necessitated for flowing of 100 ml of the powder from a bulk density-measuring hopper according to JIS K 3362. The lower the value, the higher the fluidity.

In the oozing-out test of the nonionic surfactant, 100 g of the sample was placed in a box made of a filter paper and having a width of 10.4 cm, a length of 6.4 cm and a height of 4 cm and left to stand under a load of 250 g at a temperature of 35° C. in an atmosphere having a relative humidity of 50% for two weeks. A mark of an oil-soluble ink of a ball-point pen put previously on the outer surface of the box was observed. When no oozing out was recognized at all, it was judged that the nonionic surfactant did not ooze out.

It can be understood from the test results that the products of the present invention had high fluidities and were free from the oozing out of the nonionic surfactant.

What is claimed is:

1. A method of preparing a granular, high density detergent composition comprising the steps of:

(1) forming a slurry comprising (a) an organic surfactant, (b) 2–10 wt. % of sodium carbonate or 2–15 wt. % of a water-soluble, crystalline, inorganic salt selected from the group consisting of sodium sulfate, sodium tripolyphosphate, sodium pyrophosphate, sodium orthophosphate and mixtures thereof, and (c) at least one of (i) another inorganic salt selected from the group consisting of alkali metal silicates having a molar ratio of silica to alkali metal oxide greater than 1.0 and aluminosilicate and (ii) an organic sequestering agent for a divalent metal;

(2) spray-drying the slurry to obtain a low density detergent stock;

(3) introducing the low density detergent stock and zeolite powder into a granulator and granulating to form a high density granular detergent stock having a density of at least 0.6 g/cm$^3$; and (4) dry-blending said high density granular detergent stock with 5 to 25 wt. % of a granular, water-soluble, crystalline, alkaline, inorganic salt selected from the group consisting of sodium carbonate, sodium tripolyphosphate, sodium pyrophosphate and sodium orthophosphate, the percentages being based on the total weight of the detergent composition.

2. The method of claim 1, wherein said organic surfactant (a) contains 70–100 wt. % of an anionic surfactant.

3. The method of claim 1, wherein said granular, water soluble, crystalline, alkaline, inorganic salt has an average particle size of 100 to 1000 microns.

4. The method of claim 1, wherein said granular, water-soluble, crystalline, alkaline inorganic salt has been prepared by mixing particles of an inorganic substance, which does not liberate water of crystallization at 50° C. or lower, with a nonionic surfactant at a temperature not lower than the melting point of said nonionic surfactant to form a resultant mixture, mixing the resultant mixture with an aqueous solution of polyethylene glycol to form a resultant composition and pulverizing the resultant composition.

5. The method of claim 1, wherein said granular inorganic salt is sodium carbonate having a bulk density of 0.4 to 1.0 g/ml and an average particle size of 200 to 1000 microns.

6. A method of preparing a granular, high density detergent composition comprising:

(1) forming a slurry comprising (a) 20–60 wt. % of an organic surfactant, (b) 2–10 wt. % of sodium carbonate or 2–15 wt. % of a water-soluble, crystalline, inorganic salt selected from the group consisting of sodium sulfate, sodium tripolyphosphate, sodium pyrophosphate, sodium orthophosphate and mixtures thereof, and (c) 25–80 wt. % of at least one of (i) another inorganic salt selected from the group consisting of alkali metal silicates having a mole ratio of silica to alkali metal oxide greater than 1.0 and aluminosilicate (ii) an organic sequestering agent for a divalent metal;

(2) spray-drying the slurry to obtain a low density detergent stock;

(3) introducing the low density detergent stock and zeolite powder into a granulator and granulating to form a high-density granular detergent stock having a density of at least 0.6 g/cm$^3$; and (4) dry-blending said high-density granular detergent stock with 5–35 wt. % of a granular, water-soluble, crystalline, alkaline, inorganic salt selected from the group consisting of sodium carbonate, sodium tripolyphosphate, sodium pyrophosphate and sodium orthophosphate, said granular, water-soluble, crystalline, alkaline, inorganic salt being coated with an organic substance in an amount capable of inhibiting hydration, the percentages being based on the total weight of the detergent composition.

7. The method of claim 6, wherein said organic surfactant (a) contains 70–100 wt. % of an anionic surfactant.

8. The method of claim 6, wherein said granular, watersoluble, crystalline, alkaline, inorganic salt has an average particle size of 100 to 1000 microns.

9. The method of claim 6, wherein said coated, granular, water-soluble, crystalline, alkaline inorganic salt has been prepared by mixing particles of an inorganic substance, which does not liberate water of crystallization at 50° C. or lower, with a nonionic surfactant at a temperature not lower than the melting point of said nonionic surfactant to form a resultant mixture, mixing the resultant mixture with an aqueous solution of polyethylene glycol to form a resultant composition and pulverizing the resultant composition.

10. The method of claim 6, wherein said granular inorganic salt is sodium carbonate having a bulk density of 0.4 to 1.0 g/ml and an average particle size of 200 to 1000 microns.

* * * * *